US009452915B2

(12) United States Patent
Elmbo

(10) Patent No.: US 9,452,915 B2
(45) Date of Patent: Sep. 27, 2016

(54) AXIALLY MOVABLE DRIVING SHAFT FOR A WINCH DRIVING WHEEL

(75) Inventor: Niels Peter Elmbo, Kokkedal (DK)

(73) Assignee: MAERSK SUPPLY SERVICE A/S, Copenhagen K (DK)

( * ) Notice: Subject to any disclaimer, the term of this patent is extended or adjusted under 35 U.S.C. 154(b) by 289 days.

(21) Appl. No.: 13/884,829

(22) PCT Filed: Nov. 11, 2011

(86) PCT No.: PCT/DK2011/050433

§ 371 (c)(1),
(2), (4) Date: Jul. 24, 2013

(87) PCT Pub. No.: WO2012/062335

PCT Pub. Date: May 18, 2012

(65) Prior Publication Data

US 2013/0292619 A1 Nov. 7, 2013

Related U.S. Application Data

(60) Provisional application No. 61/413,847, filed on Nov. 15, 2010.

(30) Foreign Application Priority Data

Nov. 11, 2010 (DK) ..... 2010 01025

(51) Int. Cl.

| | |
|---|---|
| ***B66D 1/00*** | (2006.01) |
| ***B66D 1/74*** | (2006.01) |
| ***B66D 1/72*** | (2006.01) |
| *B63B 21/16* | (2006.01) |

(52) U.S. Cl.
CPC ..... *B66D 1/7426* (2013.01); *B66D 1/72* (2013.01); *B63B 21/16* (2013.01)

(58) Field of Classification Search
USPC ..... 254/323
See application file for complete search history.

(56) References Cited

U.S. PATENT DOCUMENTS

| | | | | |
|---|---|---|---|---|
| 3,873,069 | A * | 3/1975 | Sprague | 254/339 |
| 4,762,185 | A * | 8/1988 | Simpson | 175/5 |
| 5,510,266 | A * | 4/1996 | Bonner et al. | 436/43 |

(Continued)

FOREIGN PATENT DOCUMENTS

| | | |
|---|---|---|
| DE | 296 02 203 U1 | 3/1996 |
| EP | 2 105 403 A1 | 9/2009 |

(Continued)

OTHER PUBLICATIONS

International Search Report for PCT/DK11/50433, mailed Mar. 30, 2012.

(Continued)

*Primary Examiner* — Emmanuel M Marcelo
(74) *Attorney, Agent, or Firm* — Brinks Gilson & Lione

(57) ABSTRACT

A winch for a ship and for hauling in or laying out chain (3) or wire and comprising a driving motor (18). A driving shaft (1), a driving wheel (2), and a turntable (5) for supporting the driving wheel are adapted so that the driving shaft (1) is essentially vertically and axially displaceable between a position in which the driving shaft (1) is positioned at one side of the top side of the turntable (5) and a position in which the driving shaft (1) is positioned at both sides of the top side of the turntable (5).

18 Claims, 3 Drawing Sheets

(56) References Cited

U.S. PATENT DOCUMENTS

| | | | | |
|---|---|---|---|---|
| 7,717,402 | B2 * | 5/2010 | Mann | 254/326 |
| 8,342,484 | B2 * | 1/2013 | Matos | 254/383 |

FOREIGN PATENT DOCUMENTS

| | | |
|---|---|---|
| GB | 338623 | 8/1930 |
| GB | 2 358 169 A | 7/2001 |
| JP | S5024665 A | 3/1975 |
| JP | 2008-264132 | 6/2006 |

OTHER PUBLICATIONS

Written Opinion for PCT/DK11/50433, mailed Mar. 30, 2012.

* cited by examiner

AXIALLY MOVABLE DRIVING SHAFT FOR A WINCH DRIVING WHEEL

RELATED APPLICATIONS

This application claims the benefit under 35 U.S.C. §371 of International Patent Application No. PCT/DK2011/050433, having an international filing date of Nov. 11, 2011, which claims priority to Danish Patent Application No. PA 2010 01025, filed Nov. 11, 2010, and U.S. Provisional Application No. 61/413,847, filed Nov. 15, 2010, the contents of all of which are incorporated herein by reference in their entirety.

A winch for a ship and for hauling in or laying out chain or wire and comprising a driving motor, a driving shaft, a driving wheel, and a turntable for supporting the driving wheel Normally, it is necessary to be able to at least replace a chain wheel by a new chain wheel having a new dimension. Also, it may be needed to shift to a drum with a wire. Irrespective of the special fields of use, the invention is particularly advantageous in connection with very heavy driving wheels and large chain dimensions. The usual way of changing very heavy driving wheels is to make use of a crane, no matter if the driving shaft of the winch is horizontal or vertical. At the very moment that the ship pitches or rolls at sea, it is extremely dangerous to have such a heavy object hanging from a crane, and the prior art therefore involves risk of accidents, which means, in practice, that the ship put into port when driving wheels are to be replaced. This is cost consuming.

It is the object of the invention to devise a winch allowing replacement of the driving wheel at rough sea with a high degree of safety.

This object is achieved in that the driving shaft is essentially vertically and axially displaceable between a position in which the driving shaft is at one side of the top side of the turntable and a position in which the driving shaft is positioned at either side of the top side of the turntable.

As it is, this construction entails that with the driving shaft retracted it is possible to pull a driving wheel away from the turntable or onto the turntable, without using a crane. This motion is accomplished by means of a number of winches mounted on the ship and pulling the driving wheel in various directions. Thus, the driving wheel is fixated in these directions; and hence there is no risk at all associated with changing driving wheels at rough sea.

In one embodiment, the driving shaft is mounted in the turntable and can be moved up above or down below the top side of the turntable. When the shaft is pushed up, it engages with the driving wheel; and when the shaft has been pulled down, the driving wheel can be removed without lifting.

In another embodiment, the driving shaft is mounted in the driving wheel, and the turntable has a hole for accommodating the driving shaft in its advanced position, i.e. from above and down into the turntable. In this position there is rotational engagement. When the driving shaft is retracted, the driving wheel and the motor pass out of engagement, and the driving wheel can be removed as described above.

Engagement means known per se are positioned between the driving shaft and driving motor and capillary wheel, respectively, said means being, in the preferred embodiment, a shaft having a hexagonal cross-section. In order to be able to thrust the driving shaft e.g. from the turntable and up into the capillary wheel, the capillary wheel must first be positioned very precisely with respect to the turntable. In order to reduce the requirements as to tolerance, the upper end of the shaft may, in one embodiment, be made conical, and/or the downwardly facing end of the hole in the capillary wheel may be made conical. At the same time it is necessary that the capillary wheel and the turntable/shaft are rotated mutually correctly, which is easily achievable by activating the motor until matching markings on turntable and capillary wheel are flush before the shaft is thrust up into the capillary wheel. The latter means are also usable if the shaft is mounted in the capillary wheel and adapted for being thrust downwardly into engagement with the turntable.

In one embodiment, there may be a magazine for driving wheels, where the magazine is level with the top side of the turntable, thus allowing the driving wheels to be replaced without lifting. In the preferred embodiment, this magazine is level with a work deck.

In the following the invention is explained in more detail, reference being made to the drawing, in which FIG. 1 shows an embodiment of a winch according to the invention;

FIG. 2 shows means for moving the driving wheels, while

Figure 1:
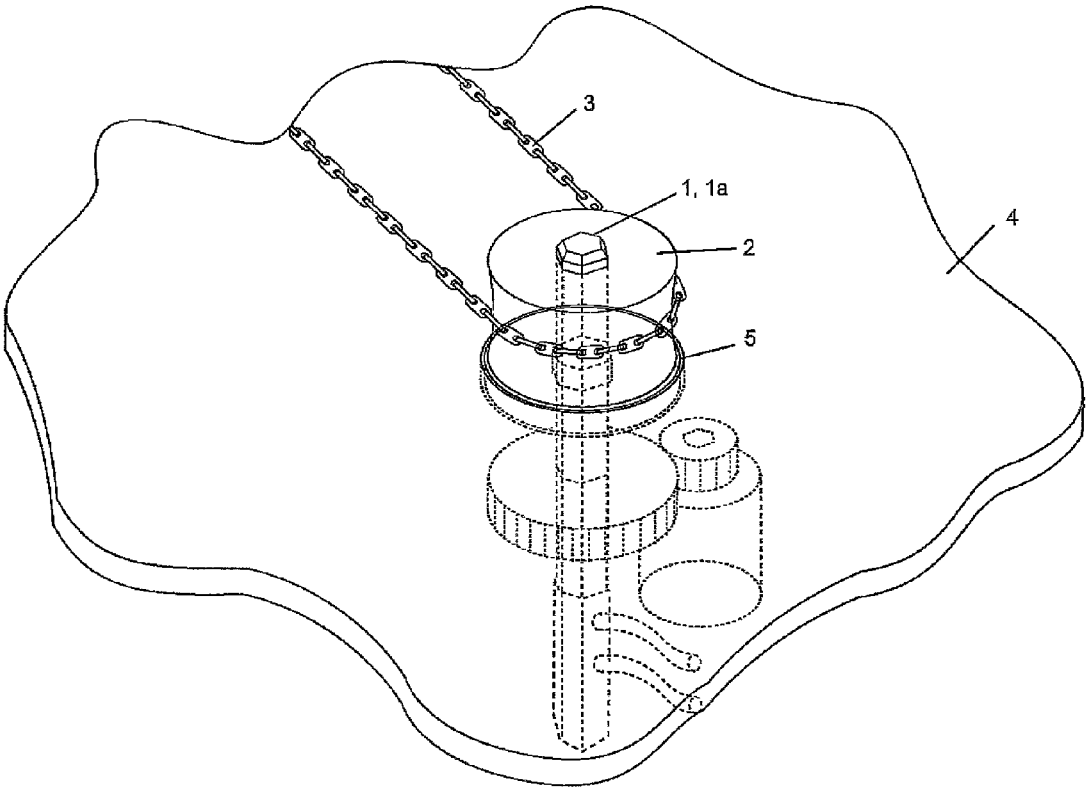

FIG. 1 shows a section of a deck 4 of a ship provided with an embodiment of a winch according to the invention, the driving wheel of the winch being shown in FIG. 1 in the form of a chain wheel or a capillary wheel 2 driven by a vertically displaceable driving shaft 1. Preferably, the shaft has a hexagonal cross-section in order to be able to transfer torque. Other known mechanisms of engagement are also usable. Other details of the winch are explained in connection with FIG. 3.

The invention concerns winches where the tractive forces may typically be 600 tons which are transferred to the shown chain 3. The chain has, therefore, a very large dimension, e.g. 6 inches, and the capillary wheel 2 is therefore correspondingly sturdy and may typically weigh 17 tons.

It is quite common for it to be needed to shift between several sizes of capillary wheels depending on which chain dimension is used. Hitherto, you had to put into port in order to be able to lift the capillary wheels by a crane, as it is extremely risky to have such heavy objects hanging from a crane in heavy seas. By means of the winch according to the invention, the capillary wheel can be changed while the ship is at sea with no risk whatsoever of personal injury or damage to equipment.

Figure 2:
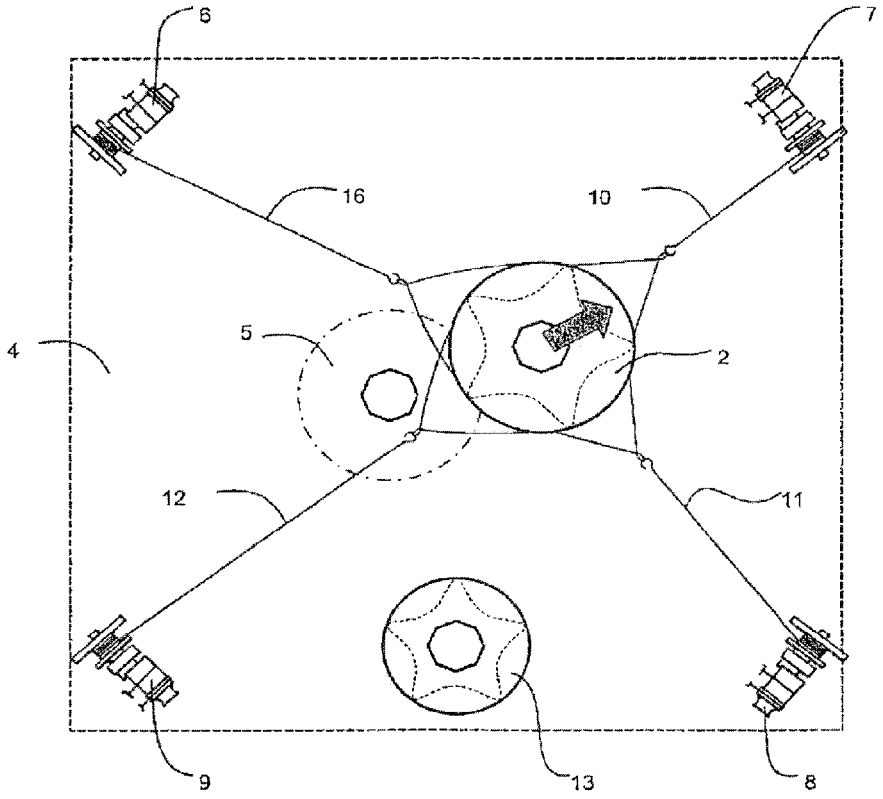

According to the invention, the capillary wheel 2 can be disengaged from the other pads of the winch so that the capillary wheel 2 can be pulled sideways across the work deck 4; see FIG. 2. The capillary wheel 2 rests on a turntable 5 which is flush with the work deck 4 so that the capillary wheel can easily be pulled to either side by means of a number of winches 6, 7, 8 and 9.

The capillary wheel 2 is fixated onto the work deck by means of steel wires 10, 11, 12, and 16 from the respective winches. FIG. 2 shows an extra capillary wheel 13, which may be retained to the work deck 4 by other means.

Some details regarding the embodiment of the winch according to the invention will now be explained with reference to FIG. 3.

Parts which are also shown in FIG. 1 are provided with the same reference numerals, for example the shaft 1, the capillary wheel 2, the chain 3, the deck 4, and the turntable 5.

Figure 3:
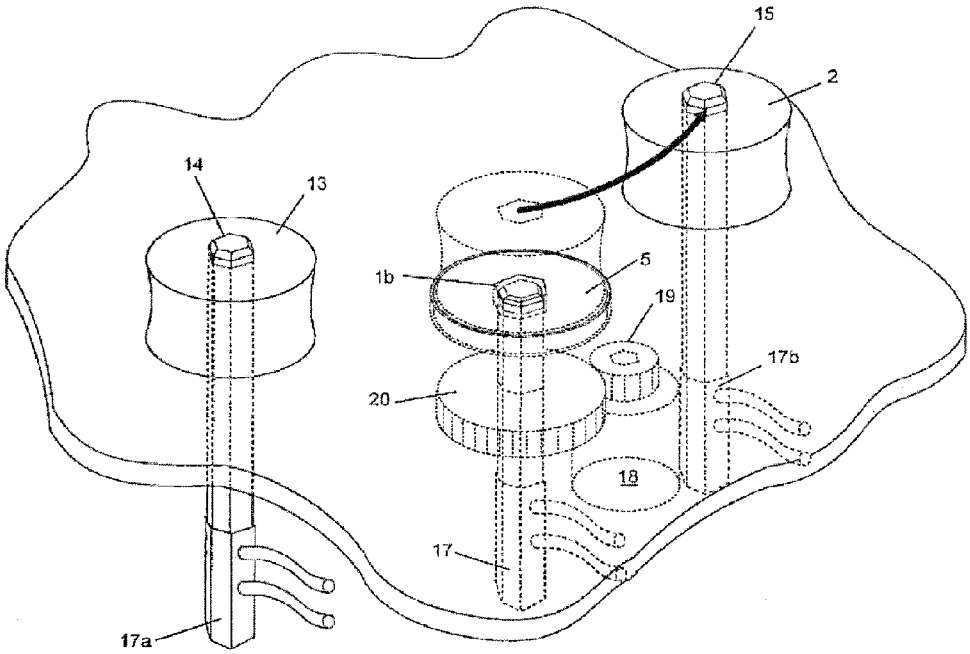
FIG. 3 shows details of an embodiment shown in FIG. 1.

FIGS. 1 and 3 show the driving shaft in two positions; viz. an upper position 1*a* and a lower position 1*b*. The shaft 1 is vertically displaceable by means of a hydraulic cylinder 17. The shaft 1 is driven by a motor 18 having a pinion 19 for cooperating with a gear-wheel 20 adopted for accommodating the shaft 1 so that torque from the motor 18 can be transferred to the shaft 1, and so that the shaft may slide up and down in the gear-wheel 20.

When the shaft 1 is in its uppermost position 1*a* (FIG. 1), the shaft is in engagement with the capillary wheel 2. In its lowermost position (FIG. 3), the shaft 1 is so far down that it is situated below an interface between the capillary wheel 2 and the turntable 5. In this position it is possible to connect the wires 10, 11, 12, and 16 with the capillary wheel 2 and pull it sideways across the work deck 4 in a manner which is entirely safe even at heavy sea (FIG. 2).

When a capillary wheel has been disengaged and is pulled sideways and fixated in a stored position, it is possible by means of e.g. the winches 6, 7, 8 and 9 to convey another capillary wheel into position flush with the shaft 1, whereafter the shaft is passed up into the new capillary wheel into engagement therewith; thus enabling the motor to transfer forces to the capillary wheel. The shaft 1 is driven vertically by a hydraulic mechanism 17. As shown in FIGS. 1 and 3, the top of the shaft is made conical. The hole in the capillary wheel 2 may also be conical at the bottom in order to facilitate positioning and insertion of the shaft 1 into the capillary wheel 2. When the shaft has a hexagonal cross-section, the shaft and the capillary wheel are to be turned mutually into a specific position. This is easily accomplished e.g. by means of matching markings on the turntable 5 and the capillary wheel 2, respectively.

In one embodiment, the extra capillary wheels are fixated in the deck 4 by means of shafts 14, 15 that are vertically displaceable by means of corresponding hydraulic mechanisms 17*a* and 17*b*, respectively.

Other uses are conceivable where a ship could pull both chain and steel wires. In such cases, both types of driving wheels could be on board and temporarily fixated onto the work deck. It is also conceivable that the invention is particularly advantageous on a trawler where there are often several bobbins with long steel wires in order to be able to draw the trawl shovels. Hence, by means of the invention it is possible to have several wire drums on board and to shift between them without it being necessary to lift them.

The invention claimed is:

1. A winch for a ship and for hauling in or laying out chain or wire comprising:

a driving motor;

a driving shaft mechanically coupled to the driving motor;

a driving wheel; and a turntable with a top surface arranged below a bottom surface of the driving wheel, the top surface of the turntable being configured to contact the bottom surface of the driving wheel to thereby support the driving wheel and turn with the driving wheel; wherein the driving shaft is vertically and axially displaceable between a position in which an end of the driving shaft is positioned at or below the top surface of the turntable and a position in which the end of the driving shaft is positioned above the top surface of the turntable and at least partially through a center of the driving wheel, wherein when the driving shaft is at or below the top surface of the turntable, the driving wheel is horizontally displaceable with respect to the turntable from a position at which the driving wheel is supported by the turntable to a position at which the turntable no longer supports the driving wheel.

2. The winch according to claim 1, wherein the driving shaft is mounted in the turntable and is movable between an advanced position in which it is in engagement with the driving wheel and a retracted position in which the driving wheel is displaceable sideways.

3. The winch according to claim 2, wherein the end of the driving shaft is configured to be thrust into the driving wheel.

4. The winch according to claim 3, wherein a downwardly facing end of a hole in the driving wheel for accommodating the driving shaft is conical.

5. The winch according to claim 3, where the turntable is driven by the driving motor, wherein an upwardly facing end of a hole in the turntable for accommodating the driving shaft is conical.

6. The winch according to claim 3, characterized in that the driving wheel is a chain wheel with pockets for chain links.

7. The winch according to claim 2, wherein a downwardly facing end of a hole in the driving wheel for accommodating the driving shaft is conical.

8. The winch according to claim 7, characterized in that the driving wheel is a chain wheel with pockets for chain links.

9. The winch according to claim 2, wherein the top surface of the turntable is level with a deck of the ship to facilitate dragging one or more driving wheels across the deck of the ship towards and away from the turntable.

10. The winch according to claim 2, wherein the driving wheel is a chain wheel with pockets for chain links.

11. The winch according to claim 1, wherein the driving shaft is mounted in the driving wheel and is movable between an advanced position in which it is in engagement with the driving motor and a retracted position in which the driving wheel is displaceable sideways.

12. The winch according to claim 11, where the turntable is driven by the driving motor, wherein an upwardly facing end of a hole in the turntable for accommodating the driving shaft is conical.

13. The winch according to claim 12, characterized in that the driving wheel is a chain wheel with pockets for chain links.

14. The winch according to claim 11, wherein the end of the driving shaft is conical and is configured to be thrust into the driving wheel or the turntable.

15. The winch according to claim 11, wherein the driving wheel is a chain wheel with pockets for chain links.

16. The winch according to claim 1, wherein the top surface of the turntable is level with a deck of the ship to facilitate dragging one or more driving wheels across the deck of the ship towards and away from the turntable.

17. The winch according to claim 1, wherein the driving wheel is a chain wheel with pockets for chain links.

18. The winch according to claim 1, wherein the driving wheel is a wire wheel.

* * * * *